US006745479B2

(12) United States Patent
Dirks et al.

(10) Patent No.: US 6,745,479 B2
(45) Date of Patent: Jun. 8, 2004

(54) CHROMIUM MOUNTED DIAMOND PARTICLE CUTTING TOOL OR WEAR SURFACE AND METHOD

(76) Inventors: Ronald S. Dirks, 865 River Knoll Way, Springfield, OR (US) 97477; Charles L. Jacobs, 4289 Larch St. NE., Salem, OR (US) 97305

( * ) Notice: Subject to any disclaimer, the term of this patent is extended or adjusted under 35 U.S.C. 154(b) by 0 days.

(21) Appl. No.: 09/978,834

(22) Filed: Oct. 16, 2001

(65) Prior Publication Data

US 2002/0078574 A1 Jun. 27, 2002

Related U.S. Application Data

(60) Provisional application No. 60/241,266, filed on Oct. 17, 2000.

(51) Int. Cl.[7] ..... B21K 11/00; B21K 11/02
(52) U.S. Cl. ..... 30/350; 76/104.1
(58) Field of Search ..... 76/DIG. 4, DIG. 12, 76/104.1, 108.17; 30/350

(56) References Cited

U.S. PATENT DOCUMENTS 3,894,673 A * 7/1975 Lowder et al. ..... 228/122
5,121,660 A * 6/1992 Kramer ..... 76/104.1
5,283,983 A 2/1994 Lazarou
5,316,559 A 5/1994 Klievoneit et al.
5,408,983 A 4/1995 Sawluk
5,488,774 A 2/1996 Janowski
5,940,975 A 8/1999 Decker et al.
5,992,268 A 11/1999 Decker et al.
6,176,888 B1 * 1/2001 Ritt et al. ..... 76/DIG. 12

FOREIGN PATENT DOCUMENTS

| | | |
|---|---|---|
| JP | 57127674 A | 8/1982 |
| JP | 1097839 | 4/1989 |
| JP | 6200213 | 6/1989 |
| WO | WO 94/26450 | 11/1994 |

* cited by examiner

*Primary Examiner*—Douglas D. Watts
(74) *Attorney, Agent, or Firm*—Steven J. Adamson

(57) ABSTRACT

A cutting tool or wear surface having diamond particles chromium mounted thereon. The diamond particles are preferably less than approximately 1,000 nanometers in length. Chromium or chromium like material is preferably mounted to an article through immersion in a bath and electroplating, amongst other techniques.

19 Claims, 1 Drawing Sheet

CHROMIUM MOUNTED DIAMOND PARTICLE CUTTING TOOL OR WEAR SURFACE AND METHOD

CROSS REFERENCE TO RELATED APPLICATIONS

This application claims the benefit of U.S. Provisional Application No. 60/241,266, filed Oct. 17, 2000, and having the same title and inventor(s) as above.

FIELD OF THE INVENTION

The present invention relates to cutting tools and wear surfaces and, more specifically, to extending the usable life of those tools and surfaces.

BACKGROUND OF THE INVENTION

Several types of cutting tools and wear surfaces are known in the art. Cutting tools include knife and saw blades, including those used to cut ceramic, wood, metal, semiconductor, etc. Wear surfaces generally refer to any industrial surface for which a hardened, extended wear surface is desired. Drums, gears, shafts, pulleys and almost any lubricated mechanically contacting surfaces are examples of wear surfaces within the present invention. While the present invention was initially developed in the context of toothed saw blades, it should be recognized that the present invention is applicable to all saw blades and wear surfaces, and particularly to metal substrated saw blades and wear surfaces.

Diamonds are known for their characteristic durability and hardness. For that reason, various diamond tipped saw blades have been developed. U.S. Patents disclosing such saw blades include U.S. Pat. Nos. 5,992,268; 5,488,774; 5,408,983; and 5,316,559. Saw blades in these patents typically utilize amorphous diamond particles or other diamond or diamond like particles. The diamond material is mounted to the saw blade substrate by nickel mediated mounting (where the nickel acts as an adhesive), direct deposition via energized plasma, and graphite fiber or vapor mediated mounting, amongst others. In general, current techniques for mounting diamond particles are disadvantageous in that they are either too complicated, too expensive or do not produce sufficient, long lasting adhesion.

For example, Japanese Patent Laid Open Patent no. JP357127674A teaches an internal peripheral saw blade in which nickel is used to mount diamond particles to the aluminum substrate of the saw blade. Nickel is used, amongst other reasons, because it is a relatively soft metal and can be worked into a solution that facilitates electroplating. As a relatively soft metal, however, nickel does not provide a desired level of adhesion when subjected to physical stresses.

U.S. Pat. No. 5,283,983, issued to Lazarou on Feb. 8, 1994, teaches a device to sharpen saw or knife blades, often referred to in the trade as a "grinder." In the sharpening or grinding device of Lazarou, the diamond particles are coated to the grinder substrate by an electro bonding-process in which the diamond particles are provided in solution with nickel chrome. This arrangement is disadvantageous in that it relies, at least in part, on nickel (which is disadvantageous for the reasons discussed above) and further in that it is limited to grinding devices. Grinding devices are typically more abrasive (rougher surfaces) and have different sized diamond particles than cutting blades or wear surfaces (wear surfaces tend to be rather smooth). Grinding devices are also typically subjected to greater abrasion forces than cutting or wear surfaces.

SUMMARY OF THE INVENTION

Accordingly, it is an object of the present invention to provide a saw blade or wear surface that has increased durability and extended life compared to prior art saw blades or wear surfaces.

It is another object of the present invention to provide such saw blades or wear surfaces in a cost effective manner.

It is another object of the present invention to provide saw blades or wear surface that are "hardened" with a layer of diamond particles that are mounted to the substrate with chromium.

It is also an object to use nanometer range diamond particles, amongst other sizes, in achieving saw blades or wear surfaces in accordance with the present invention.

In one embodiment, the present invention includes an article used in cutting or as a wear surface that has a body having a first surface, diamond particles, and a chromium containing material coupling the diamond particles to the first surface. The diamond particles may be less than approximately one micrometer in length or between 500 and 0.05 nanometers in length, or another size. The chromium containing material may contain elemental chromium and/or a chromium alloy. The surface having the diamond particles mounted thereon may be a cutting surface or a wear surface.

The present invention also includes an article made by the process of providing an article body having a first surface, providing diamond particles, and mounting the diamond particles to the first surface with a chromium containing material.

A method of forming such an article is also within the present invention.

These and related objects of the present invention are achieved by use of a chromium mounted diamond particle cutting tool or wear surface (and method and making same) as described herein.

The attainment of the foregoing and related advantages and features of the invention should be more readily apparent to those skilled in the art, after review of the following more detailed description of the invention taken together with the drawings.

DETAILED DESCRIPTION

Figure 1:
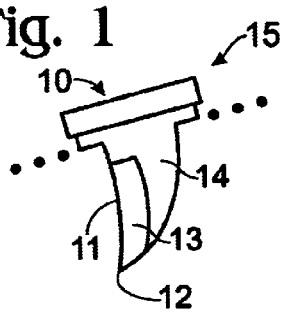
FIGS. 1–5 illustrate saw or cutting blades in accordance with the present invention.
Figure 2:
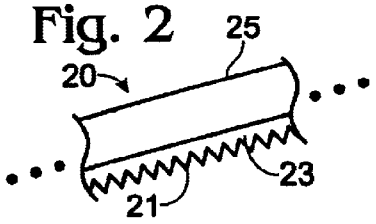
Figure 3:
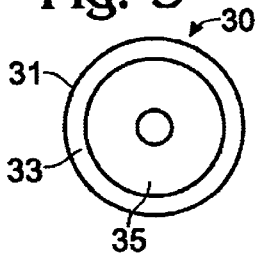
Figure 4:
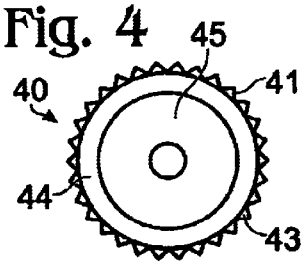
Figure 5:
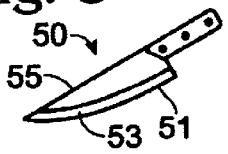
Figure 6:
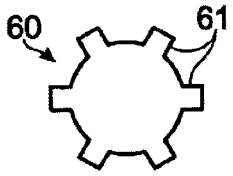
FIGS. 6–9 illustrate articles with wear surfaces that are treated in accordance with the present invention.
Figure 7:
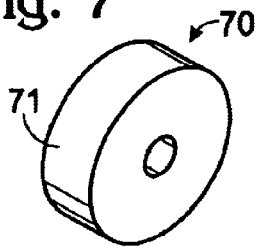
Figure 8:
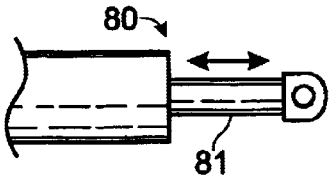
Figure 9:
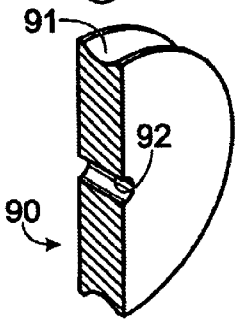

Referring to FIGS. 1–5, various saw blade or "cutting tools" in accordance with the present invention are shown. FIG. 1 illustrates a saw blade tooth 10 which is preferably part of a series of similar teeth. Tooth 10 includes a cutting edge 11 and tip 12. FIG. 2 illustrates a section of a ban or cross-cut or like type of saw blade 20 and a cutting edge 21. FIG. 3 illustrates a circular saw blade 30 and cutting edge 31 of the type used to cut ceramic, masonry, semiconductor, metal or like material. FIG. 4 illustrates a circular saw blade 40 and cutting edge 41 with teeth (or more pronounced teeth) of the type used to cut some metal, wood and other materials. FIG. 5 represents a generic cutting tool 50 and cutting edge 51. Tool 50 could be used in a domestic capacity or mounted to machinery and used in an industrial capacity or the like.

The embodiments of FIGS. 1–5 are not intended to be limiting, but contrarily, to illustrate the general breath of application of the present invention to cutting tools and surfaces of all types.

The present invention includes processing the cutting edge or surface of the blade to increase the strength and durability of that edge. This is achieved by mounting diamond particles of a preferred size to the saw substrate as discussed in more detail below. The diamond particles may be mounted to the entire blade or to the cutting edge region thereof. Blade 10 of FIG. 1 illustrates a region 13 to which the diamond particles are mounted or a larger region 14 that receives the particles. FIGS. 2–5 illustrate cutting edge regions 23,33,43 and 53 to which the diamond particles are preferably mounted.

In preparation for electro-plating, a diamond particle-chromium bath is preferably created. This bath is made up of water, chromium, sulfuric acid and diamond particles. The chromium is preferably provided as flakes and mixed with water. The sulfuric acid is then added, followed by the diamond particles. (Sulfuric acid helps catalyze the attachment of chromium to the metallic article body.) The mix ratio is approximately 30 oz. of chromium to 1 gallon of water. Sulfuric acid concentrations are relatively low, e.g., approximately 8 oz. per 100 gallons or the like. Diamond particles are preferably added at a rate of approximately 30–33 carats (weight) per gallon.

The diamond particles are preferably obtained from raw diamond processing waste or another economical source. For example, raw diamond processing and polishing operations typically produce waste diamond "dust." These dust particles may be collected and separated by size, and their cost tends to be proportional to the size of the separated particles, i.e., smaller particles, smaller cost. In a preferred embodiment, the diamond particles are between 1 and 50 nanometers in length and more preferably between 8 and 25. These particles are available commercially. While particles of these sizes are preferred, particles that are approximately 1000 nanometer (1 micrometer) or less are generally within the present invention and may be utilized depending on the intended use. For example, particles of 1000, 500, 50, 5, 0.5, 0.05 nanometers or less may be desired for a particular purpose. Particles greater than 1000 nanometers may also be desired in some instances, and may also be within the present invention. As particle size increases, the ability of the chromium to securely hold the particles may be compromised and the smoothness of the cutting or wear surface may be less. The price of the particles may also increase. As particle size decreases, under a certain size, the hardness provided by the particles may be compromised due to losses in structural integrity.

In preparation for electro-plating, a diamond particle-chromium path is preferably created. This bath is made up of water, chromium, sulfuric acid and diamond particles. The chromium is preferably provided as flakes and mixed with water. The sulfuric acid is then added, followed by the diamond particles. (Sulfuric acid helps catalyze the attachment of chromium to the metallic article body.) The mix ratio is approximately 30 oz. of chromium to 1 gallon of water. Sulfuric acid concentrations are relatively low, e.g., approximately 8 oz. per 100 gallons or the like. Diamond particles are preferably added at a rate of approximately 30–33 carats (weight) per gallon.

Diamond particles of the preferred size will remain suspended in the chromium bath for a suitable time period to permit effective diamond mounting via electroplating. A desired part (blade or wear surface, etc.) which is preferably made of a metallic or other electricity conducting material is dipped in the bath and electricity is applied to drive the chromium and diamond solution onto the part; the electrically attracted chromium pulls the diamond particles onto the part. The chromium-diamond mixture may be provided in a smaller region 13,43 of a part or a wider region 14,44. A part may also be etched after electroplating to achieve a desired chromium-diamond patterning.

Note that a chromium alloy may also be used to mount the diamond particles to the part. In this case, the chromium alloy is preferably provided as flakes and mounted through a process similar to that discussed above.

Referring to FIGS. 6–9, various articles having wear surfaces in accordance with the present invention are shown. FIGS. 6–9 are intended to be illustrative of various wear surfaces that are within the present invention and further to illustrate how to prepare a wear surface within the present invention on other articles. FIGS. 6–9 show a gear 60, a belt drive drum 70, a moving shaft 80 and a cross-section of a pulley 90, respectively. These articles all contain wear surfaces 61, 71, 81 and 91, respectively. Interior opening 92 within pulley 90 may also be a wear surface depending on use.

Articles 60,70,80 and 90 are preferably subjected to processing as described above to form the chromium-diamond particle wear surfaces 61,71,81 and 91 (and possibly 92). These surfaces thus preferably include a chromium diamond layer formed by electroplating that provides hardness, extended life and less susceptibility to corrosion.

It should be recognized that chromium or chromium like metals are preferred because they are stronger than nickel or similar metals or alloys and thus, will provide longer life and more resistance to corrosion, whether used on a blade or wear surface. Chromium and chromium like substances are also preferred due to their ease of use.

It should also be recognized that the present invention has broad industrial applicability. All types of knives, fan blades for chippers, feed plates, planner gibbs and guide bars, V rails for finger joint machines, wear inserts for chippers, amongst other articles, may be treated as discussed herein and are within the present invention when so treated.

While the invention has been described in connection with specific embodiments thereof, it will be understood that it is capable of further modification, and this application is intended to cover any variations, uses, or adaptations of the invention following, in general, the principles of the invention and including such departures from the present disclosure as come within known or customary practice in the art to which the invention pertains and as may be applied to the essential features hereinbefore set forth, and as fall within the scope of the invention and the limits of the appended claims.

What is claimed is:

1. An article for use in cutting or as a wear surface, comprising:

a body having a first surface thereon;

diamond particles; and a chromium containing material coupling said diamond particles to said first surface of said body;

wherein said coupling material is at least 40% chromium by weight.

2. The article of claim 1, wherein said diamond particles are substantially between 500 and 0.05 nanometers in length.

3. The article of claim 1, wherein said first surface is a cutting surface.

4. The article of claim 1, wherein said first surface is a wear surface.

5. A method of making an article for use in cutting or as a wear surface, comprising the steps of:

providing an article body having a first surface;

providing diamond particles; and mounting said diamond particles to said first surface with a chromium containing material in a non-sintered process;

wherein said diamond particle providing step includes the step of providing diamond particles that are substantially between 500 and 0.05 nanometers in length.

6. The method of claim 5, wherein said mounting step includes the step of preparing a bath including said chromium containing material and dipping said first surface of said article body into said bath.

7. The method of claim 6, wherein said mounting step further comprises the step of electroplating said chromium containing material to said first surface of said article body.

8. The method of claim 6, wherein said mounting step further comprises the step of providing said bath to include at least water, sulfuric acid and said chromium containing material.

9. The method of claim 5, wherein said mounting step includes the step of mounting said diamond particles with a chromium containing mounting material that includes at least 30% chromium by weight.

10. The method of claim 5, wherein said mounting step includes the step of mounting said diamond particles with a chromium containing mounting material, the majority of which by weight is chromium.

11. The method of claim 5, wherein said diamond particle providing step includes the step of providing diamond particles that are substantially between 500 and 0.05 nanometers in length.

12. A method of making an article for use in cutting or as a wear surface, comprising the steps of:

providing an article body having a first surface;

providing diamond particles; and mounting said diamond particles to said first surface with a chromium containing material in a non-sintered process;

wherein said mounting step includes the step of preparing a bath including said chromium containing material and dipping said first surface of said article body into said bath.

13. A method of making an article for use in cutting or as a wear surface, comprising the steps of:

providing an article body having a first surface;

providing diamond particles; and mounting said diamond particles to said first surface with a chromium containing material in a non-sintered process;

wherein said mounting step comprises the step of electroplating said chromium containing material to said first surface of said article body.

14. The article claim 1, wherein said diamond particles are substantially between 50 and 0.5 nanometers in length.

15. The article of claim 1, wherein said coupling material is at least half chromium by weight.

16. The article of claim 1, wherein said diamond particles are less than approximately one micrometer in length.

17. The article of claim 1, wherein said diamond particles are less than approximately 500 nanometers in length.

18. The article of claim 1, wherein said body has width, length and height dimensions and at least one of said width, length and height dimensions is greater than 5 millimeters.

19. The article of claim 18, wherein said one of said width, length and height dimensions is greater than 1 centimeter.

* * * * *